US008141328B2

(12) United States Patent
Villers et al.

(10) Patent No.: US 8,141,328 B2
(45) Date of Patent: Mar. 27, 2012

(54) SYSTEM AND METHOD FOR FREE-STANDING STORAGE OF AGRICULTURAL COMMODITIES USING A HERMETIC LIGHTWEIGHT SLEEVE

(75) Inventors: Philippe Villers, Concord, MA (US); Tom De Bruin, Kibbutz HaOgen (IL); Shlomo Navarro, Rishon Letsion (IL)

(73) Assignee: GrainPro, Inc., Concord, MA (US)

( * ) Notice: Subject to any disclaimer, the term of this patent is extended or adjusted under 35 U.S.C. 154(b) by 625 days.

(21) Appl. No.: 12/359,868

(22) Filed: Jan. 26, 2009

(65) Prior Publication Data

US 2010/0192998 A1 Aug. 5, 2010

(51) Int. Cl.
*B65B 61/00* (2006.01)

(52) U.S. Cl. ..... 53/410; 53/139.2; 53/284.7; 53/461; 53/469; 53/567

(58) Field of Classification Search ..... 53/138.7, 53/139.2, 173, 284.7, 416, 459, 461, 469, 53/567, 570

See application file for complete search history.

(56) References Cited

U.S. PATENT DOCUMENTS

| | | | | |
|---|---|---|---|---|
| 234,185 | A | 11/1880 | Hendrick | |
| 1,340,718 | A | 5/1920 | Johnson | |
| 2,624,886 | A | 1/1953 | Herman | |
| 2,730,150 | A | 1/1956 | Wunderwald et al. | |
| 2,914,776 | A | 12/1959 | Hotz | |
| 3,167,209 | A * | 1/1965 | Jones | 383/22 |
| 3,485,635 | A | 12/1969 | Fassauer | |
| 3,727,656 | A | 4/1973 | Luders | |
| 3,949,527 | A | 4/1976 | Double et al. | |
| 4,084,358 | A | 4/1978 | Winters | |
| 4,208,443 | A | 6/1980 | Kanuch et al. | |
| 4,224,770 | A | 9/1980 | Petty | |
| 4,413,029 | A | 11/1983 | Handwerker | |
| 4,508,737 | A | 4/1985 | Forest et al. | |
| 4,516,906 | A * | 5/1985 | Krein | 414/809 |
| 4,521,372 | A | 6/1985 | Price et al. | |
| 4,660,337 | A | 4/1987 | Ross, III et al. | |
| 4,729,198 | A | 3/1988 | Nethery | |
| 4,897,970 | A | 2/1990 | Double et al. | |

(Continued)

FOREIGN PATENT DOCUMENTS

IL 87301 3/1996

(Continued)

OTHER PUBLICATIONS

Silage Density and Dry Matter Loss in Silo Bags by Mike Rankin, date unknown, http://www.uwex.edu/CES/croops/silobagdensity,htm.

(Continued)

*Primary Examiner* — Thanh Truong
(74) *Attorney, Agent, or Firm* — Weingarten, Schurgin, Gagnebin & Lebovici LLP

(57) ABSTRACT

A system and method for free-standing hermetic storage of bulk, boxed or bagged commodities including the use of a thin, lightweight ultra low permeability loadable sleeve, and optionally a UV-, wind- and rodent-resistant cover on top of the sleeve. For bagged or boxed commodities, loading may be done manually or with a forklift while the sleeve and/or cover is held open. For bulk commodities, the cover is used to prevent tearing of the sleeve during loading and as such, is placed over the sleeve prior to loading of the sleeve via a pneumatic grain conveyor or similar device.

13 Claims, 13 Drawing Sheets

U.S. PATENT DOCUMENTS

| | | | | | |
|---|---|---|---|---|---|
| 4,911,317 | A | * | 3/1990 | Schloesser et al. | 220/1.5 |
| 5,110,005 | A | * | 5/1992 | Schilling | 220/495.08 |
| 5,170,599 | A | | 12/1992 | Knight | |
| 5,244,332 | A | * | 9/1993 | Krein et al. | 414/467 |
| 5,288,266 | A | | 2/1994 | Halley | |
| 5,363,605 | A | | 11/1994 | Handwerker | |
| 5,547,331 | A | * | 8/1996 | Podd et al. | 414/808 |
| 5,657,896 | A | * | 8/1997 | Matias | 220/1.6 |
| 6,132,088 | A | * | 10/2000 | Suzuki | 383/23 |
| 6,186,713 | B1 | | 2/2001 | Bonerb | |
| 6,609,354 | B1 | | 8/2003 | Villers | |
| 6,941,727 | B2 | | 9/2005 | Villers et al. | |
| 7,416,091 | B2 | * | 8/2008 | Yong | 220/1.6 |
| 7,506,776 | B2 | * | 3/2009 | Podd | 220/1.6 |
| 7,845,511 | B1 | * | 12/2010 | Strickland et al. | 220/495.11 |
| 2003/0152671 | A1 | | 8/2003 | Johnstone | |
| 2005/0208157 | A1 | | 9/2005 | Navarro et al. | |
| 2006/0198861 | A1 | | 9/2006 | Villers et al. | |
| 2008/0202213 | A1 | | 8/2008 | Villers et al. | |
| 2008/0299272 | A1 | | 12/2008 | Navarro et al. | |

FOREIGN PATENT DOCUMENTS

| | | |
|---|---|---|
| WO | WO-99/28578 | 6/1999 |
| WO | WO-99/45787 | 9/1999 |

OTHER PUBLICATIONS

Speech delivered on Jun. 7, 2007 by Sophie Mirabella to the Australian Wheat Board, http://www.silobag.com.au/home/.

Villers, et al., "Development and Applications of the Hermetic Storage Technology," Proceedings of the 9th International Working Conference on Stored Product Protection, Oct. 15 to 18, 2006, Campinas, São Paulo, Brazil. Brazilian Post-harvest Association—ABRAPOS, Passo Fundo, RS, Brazil, 2006, pp. 719-729 (ISBN 8560234004).

"GrainPro SuperGrainbags", Jul. 2004, GrainPro, Inc., Concord, MA, www.grainpro.com.

* cited by examiner

SYSTEM AND METHOD FOR FREE-STANDING STORAGE OF AGRICULTURAL COMMODITIES USING A HERMETIC LIGHTWEIGHT SLEEVE

FIELD OF THE INVENTION

The present invention relates to storage of commodities and, more particularly to systems and methods for free-standing storage of bagged and bulk commodities.

BACKGROUND OF THE INVENTION

Free-standing storage containers for bagged agricultural commodities are prone to insect infestation and infestation development and growth of molds and resulting toxins. A storage container which provides hermetic free-standing storage to prevent these problems is the Cocoon™ storage container (GrainPro, Inc., Concord, Mass.). Cocoon™ storage containers are rectangular shaped gas tight envelopes comprised of flexible UV resistant PVC. They are designed for long term outdoor or indoor storage of agricultural commodities in bags.

However, storage of bagged or boxed commodities in these containers is limited, because the containers are relatively heavy and expensive. Moreover, loose grains (bulk commodities) cannot be stored long term in these containers at all, due to lack of sufficient support.

What is needed therefore is long term free-standing storage of both bagged and bulk agricultural commodities in a relatively low-cost and lightweight container, which can be used indoors or adapted for outdoor use by providing UV and wind protection.

BRIEF SUMMARY OF THE INVENTION

There is provided, in accordance with embodiments of the present invention, a multi-ton capacity system for hermetic storage of commodities. The system includes a thin, lightweight loadable sleeve having a first end, a second end, and a body extending from the first end to the second end, wherein the first end, second end and body define an inner cavity for loading of commodities. The first end has an opening for accessing the inner cavity. The system further includes an inner cavity opener configured to allow the sleeve to remain open for loading and a fastener positioned at the first end for fastening the first end to form a hermetic seal.

In accordance with further embodiments of the present invention, the sleeve may be comprised of a co-extruded multi-layer material having a thickness in a range of 0.08-0.2 mm, having an outer layer; an inner layer; and a middle layer, wherein the middle layer is comprised of one or more ultra-low permeability materials.

In some embodiments, the inner cavity opener may include a blower and a single section of a frame to prevent the sleeve from blowing away. In other embodiments, the inner cavity opener may be a frame having multiple sections, wherein an upper portion of the body of the sleeve is hung from the frame. In yet additional embodiments, the inner cavity opener includes a series of stiffened tubes surrounding the body of the sleeve. The stiffened tubes may be inflatable. The body of the sleeve may in some embodiments be substantially rectangular in cross-section, and in other embodiments may be substantially ellipsoidal in cross-section, with a flat bottom.

In accordance with additional embodiments of the present invention, the system may further include a protective outer cover having rodent proof, wind resistant and/or UV resistant properties. A portion of the outer cover may be positioned under the body of the sleeve and a remaining portion of the outer cover may be configured to be placed over the body of said sleeve by unrolling, thereby covering the sleeve. In some embodiments, the remaining portion of the outer cover may be attached to at least one rope for placing the remaining portion over the body of the sleeve by unrolling the remaining portion of the outer cover.

In some embodiments, the system may further include a sensing port for self-monitoring. In additional embodiments, the sleeve may further include a coating or impregnation of a compound of botanical origin to improve resistance to insect penetration.

There is provided, in accordance with additional embodiments of the present invention, a method of hermetically storing a multi-ton load of bagged or boxed commodity. The method includes providing a thin, lightweight loadable sleeve having a first end, a second end, and a body extending from the first end to the second end, wherein the first end, second end and body define an inner cavity for loading of commodities and wherein the first end has an opening for accessing the inner cavity, hanging the sleeve from a frame so as to keep the opening open for loading, loading bags of commodity through the opening into the inner cavity, and hermetically sealing the first end.

In accordance with further embodiments of the present invention, the method may further include placing a protective floor mat in the inner cavity and the loading may include loading the bags or boxes of commodity with a forklift onto the protective floor mat. In some embodiments, the method may further include placing an outer cover over the sleeve after the loading. In some embodiments, initially a portion of the outer cover may be positioned under the sleeve, and the placing includes placing a remaining portion of the outer cover over the sleeve and the loaded bags or boxes by unrolling the remaining portion of the outer cover. In some embodiments, a blower may be placed next to the opening to aid in keeping the opening open during loading.

The hermetic sealing may be done with tape, a zip lock type closure, a clamp, or a tie or any other suitable method. In some embodiments, a coating or impregnation of a compound of botanical origin may be provided to said sleeve.

There is provided, in accordance with yet additional embodiments of the present invention, a method of hermetically storing a multi ton bulk commodity. The method includes providing a thin, lightweight loadable sleeve having a first end, a second end, and a body extending from the first end to the second end, the first end, second end and body defining an inner cavity for loading of commodities, wherein the first end has an opening for accessing the inner cavity, keeping the opening open for loading of the commodity, placing an outer cover over the sleeve, propelling the bulk commodity into the inner cavity while the opening is kept open and while the outer cover remains over the sleeve, and hermetically sealing the opening.

In some embodiments, initially a portion of the outer cover is positioned under the sleeve, and placing the remaining portion of the outer cover over the sleeve by, for example, unrolling the remaining portion of the outer cover. In some embodiments, keeping the opening open is done by placing a blower next to the opening and blowing air into the inner cavity. In other embodiments, keeping the opening open is done be inflating inflatable tubes attached to the sleeve.

The hermetic sealing may be done with tape, a zip lock type closure, a clamp, or a tie or any other suitable method. In some embodiments, a coating or impregnation of a compound of botanical origin may be provided to said sleeve.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. In case of conflict, the patent specification, including definitions, will control. In addition, the materials, methods, and examples are illustrative only and not intended to be limiting.

BRIEF DESCRIPTION OF THE SEVERAL VIEWS OF THE DRAWINGS

The above and further advantages of the present invention may be better understood by referring to the following description in conjunction with the accompanying drawings in which.

Figures 1A, 1B, 2:
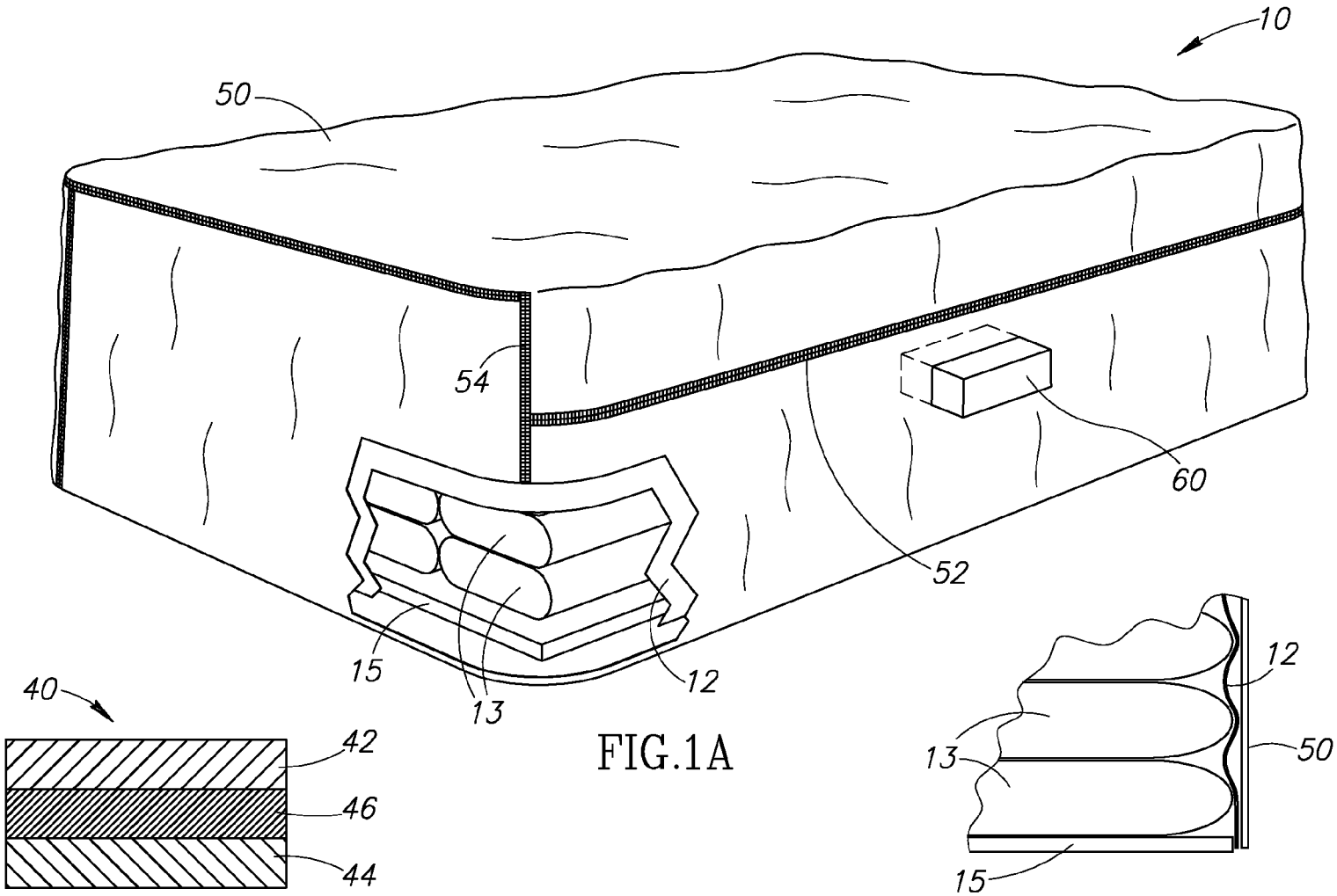
FIGS. 1A and 1B are a partially cut-away perspective illustration and a partial cross-sectional illustration, respectively, of a system for free-standing storage of bagged commodities, in accordance with embodiments of the present invention.
FIG. 2 is a cross-sectional illustration of a material for use as a sleeve in the system of FIGS. 1A and 1B, in accordance with one embodiment of the present invention.

It will be appreciated that for simplicity and clarity of illustration, elements shown in the drawings have not necessarily been drawn accurately or to scale. For example, the dimensions of some of the elements may be exaggerated relative to other elements for clarity or several physical components may be included in one functional block or element. Further, where considered appropriate, reference numerals may be repeated among the drawings to indicate corresponding or analogous elements. Moreover, some of the blocks depicted in the drawings may be combined into a single function.

DETAILED DESCRIPTION OF THE INVENTION

In the following detailed description, numerous specific details are set forth in order to provide a thorough understanding of the present invention. It will be understood by those of ordinary skill in the art that the present invention may be practiced without these specific details. In other instances, well-known methods, procedures, components and structures may not have been described in detail so as not to obscure the present invention.

The present invention is directed to systems and methods for storage of agricultural commodities, and more particularly to hermetic storage of a bulk or bagged agricultural commodity in a lightweight, loadable sleeve. The systems and methods of the present application are designed to preserve quality and prevent moisture damage of commodities stored in bulk or bagged form due to increases in moisture content, the effects of oxygen, or condensation that may occur during storage. The principles and operation of systems and methods according to the present invention may be better understood with reference to the drawings and accompanying descriptions.

Before explaining at least one embodiment of the present invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein are for the purpose of description and should not be regarded as limiting.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination.

Bagged or Boxed Agricultural Commodities

Version 1: For Outdoor Use

Reference is now made to FIG. 1A and FIG. 1B, which are a partially cut-away perspective illustration and a partial cross-sectional illustration, respectively, of a system 10 for free-standing storage of bagged or boxed commodities, in accordance with embodiments of the present invention. System 10 includes a thin, lightweight sleeve 12 for storage of bags 13 having the agricultural commodities therein. Bags 13 may be laid on a protective mat 15 positioned on a floor of sleeve 12 so as to protect sleeve 12 during loading and unloading of bags 13, as will be described hereinbelow. An outer cover 50 may be positioned over sleeve 12. Outer cover 50 may include a side zipper 52 and a front zipper 54 for closure of outer cover 50, or may include other types of closures. System 10 may further include a sensing port 60 for self-monitoring, similar to sensing ports disclosed in U.S. patent application Ser. No. 11/677,636, entitled "System and Method for Self-Verification of Safe Storage within Hermetically Sealed Containers," filed Feb. 22, 2007, and published as US Publication Number 2008/0202212 on Aug. 28, 2008, and incorporated herein by reference in its entirety for all purposes. Sensing port 60 may extend through both sleeve 12 and outer cover 50, when applicable.

Sleeve 12 is a thin, lightweight liner formed from a co-extruded multi-layer material having a thickness in a range of 0.08-0.2 mm with a weight of 75 to 187 gm/m$^2$. Reference is now made to FIG. 2, which is a cross-sectional illustration of a material 40 for use as sleeve 12 in accordance with one embodiment of the present invention. Material 40 includes an outer layer 42 and an inner layer 44, with a middle layer 46 sandwiched between outer and inner layers 42 and 44. In accordance with embodiments of the present invention, outer layer 42 and inner layer 44 are co-extruded with middle layer 46. The purpose of middle layer 46 is to provide low permeability, while the outer and inner layers 42 and 44 are designed to add strength to and to protect middle layer 46. Middle layer 46 may include one or more ultra-low permeability layers, and may include multiple low permeability materials.

In some embodiments, any one or several of outer layer 42, inner layer 44 and middle layer 46 may include multiple layers of material. Typically, permeability to oxygen is in the range of 3 to 55 cc/m$^2$/day at 23° C. and for water vapor of 8 g/m$^2$/day at 38° C. In one embodiment, middle layer 46 is nylon (PA). In another embodiment, middle layer 46 is EVOH. In yet another embodiment, middle layer 46 is comprised of a combination of two or more materials. For example, a material that has exceptionally low permeability to oxygen, but not to moisture may be combined with a material that has low permeability to water vapor but not as low permeability to oxygen. It should be readily apparent that middle layer 46 may be comprised of any low permeability barrier material or combination of materials suitable for sandwiching between an outer layer and an inner layer. Examples include PE/PA/PE, or PE/EVOH/PE coextruded materials. Alternatively, outer and inner layers 42 and 44 can be comprised of any other plastic film compatible with being co-extruded with low permeability middle layer 46 and having permeabilities to oxygen between 3 and 55 cc/m$^2$/day, for example.

In one embodiment, material 40 may additionally include a coating or impregnation of a compound of botanical origin to improve resistance to insect penetration. An example of a natural pesticide suitable for impregnation or coating is an essential oil such as produced by Biopack, Ltd. (Caesaria, Israel) and described more fully in U.S. patent application Ser. No. 10/816,861, filed on Apr. 5, 2004, and published as US Publication Number 2005/0208157 on Sep. 22, 2005, and Israel Patent Application Number 160950, both of which are incorporated herein by reference in their entireties for all purposes. This insect repellent material is intended to further prevent possible insect penetration of the liner. Methods for impregnating plastic films with essential oils are known in the art, and are described in, for example, U.S. Patent Publication Number 2005/0208157 referenced above. Specifically, a composition of matter suitable for fabricating polymer-based packaging materials can be generated by mixing ar-trumer-one sesquiterpene alcohols and/or turmeric oleoresin solid residue with polymers as a melt, by solvent compounding, or by immobilization or covalently linking of these compounds to the polymers.

In some embodiments, sleeve 12 may have a thickness of approximately 0.08 mm to 0.2 mm, with up to a 12-meter circumference and any length. In one embodiment, the size is approximately 3-meters wide by 3-meters high by any amount of meters long. This size can match the capacity of a standard commercial 20-ft or 40-ft container.

Use of a thin, lightweight sleeve 12 such as those described above provides a lower cost, lower weight method for hermetically storing bagged commodities. However, use of a thin, lightweight sleeve 12 such as the ones described herein creates challenges in loading and unloading of the agricultural commodity, and may not have sufficient sturdiness to withstand external influences over the long-term. Thus, the systems and methods of the present invention are designed for facilitating loading and unloading of bagged agricultural commodities when using a lightweight sleeve for hermetic storage.

Figure 3A:
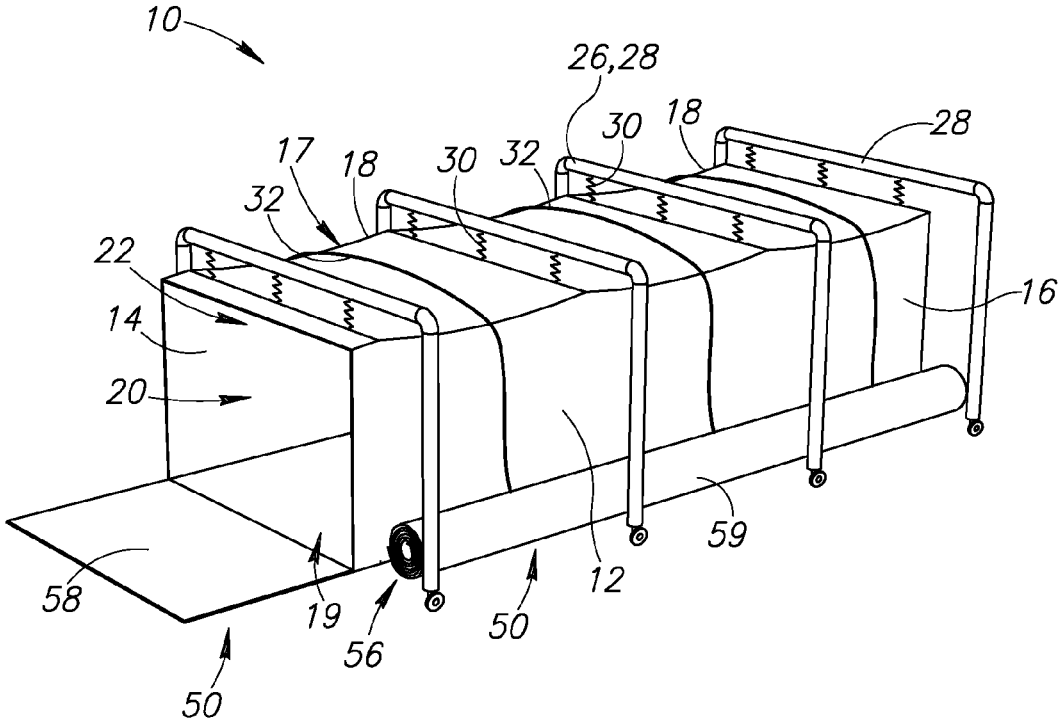
FIGS. 3A-3D are schematic illustrations of the steps of a method of holding the sleeve of FIGS. 1A-1B open during loading of bags of an agricultural commodity, in accordance with embodiments of the present invention.
Figure 3B:
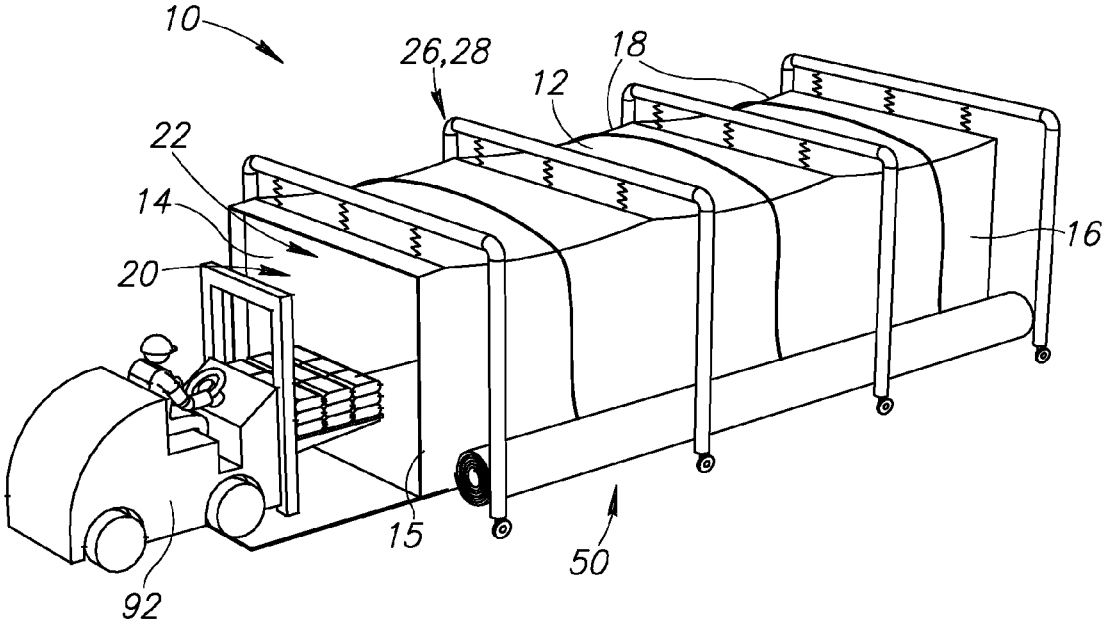
Figure 3C:
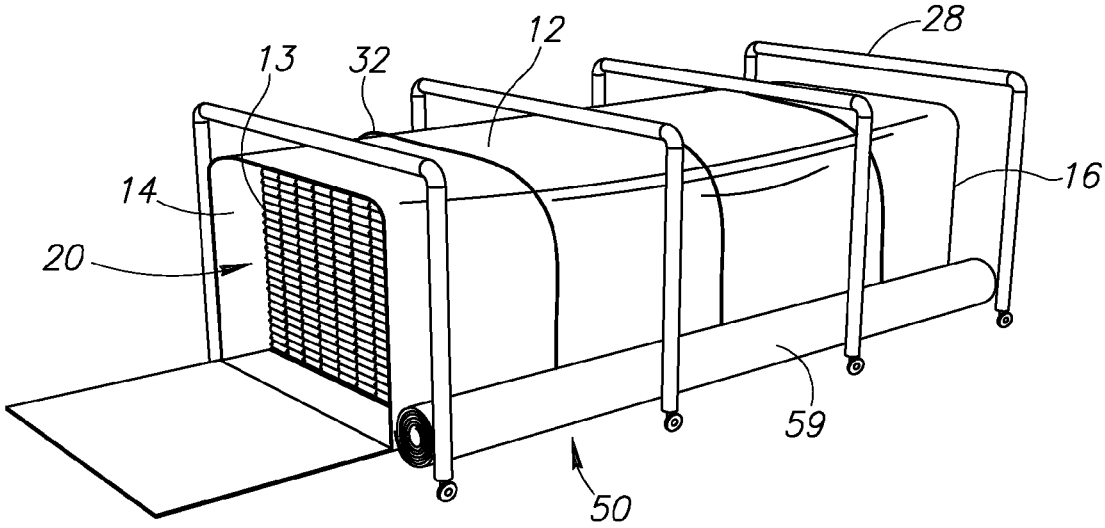
Figure 3D:
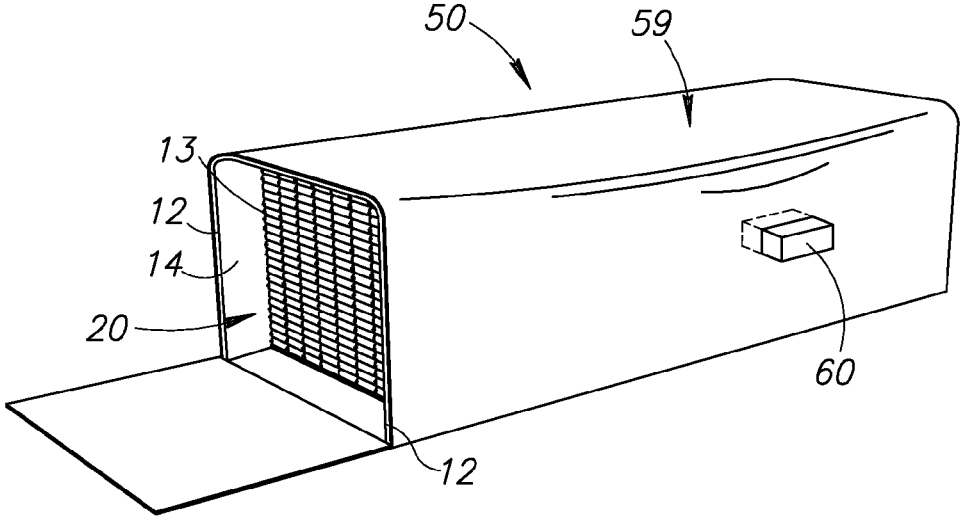
Figure 4:
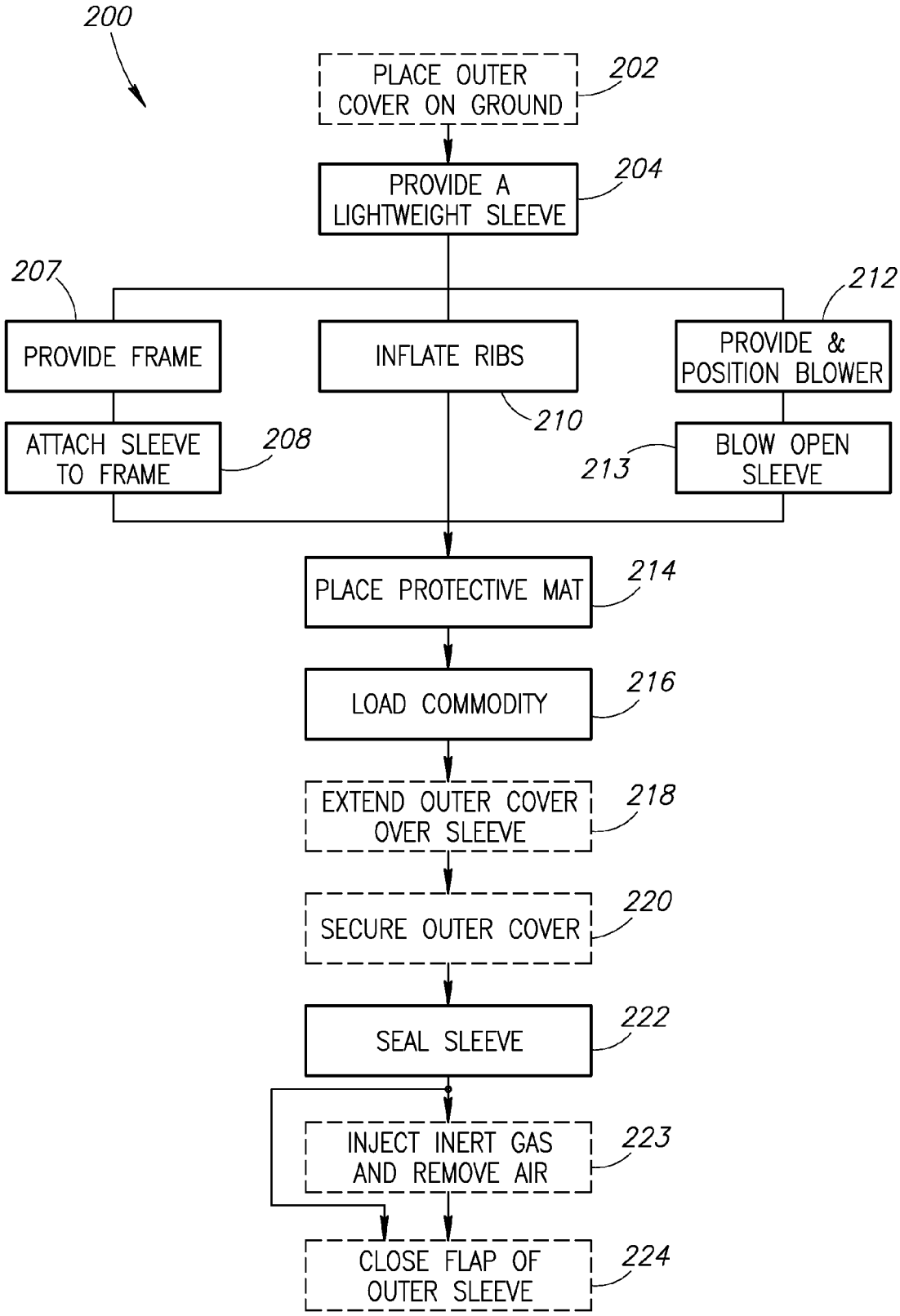
FIG. 4 is a flow-chart diagram of the steps of the method of FIGS. 3A-3D.

Reference is now made to FIGS. 3A-3D and to FIG. 4, which are schematic illustrations and a flow-chart diagram, respectively, of steps of a method 200 of holding sleeve 12 open and loading bags 13 of an agricultural commodity therein, in accordance with embodiments of the present invention. Although the steps of the method shown include placement of an outer protective cover, it should be readily apparent that in some embodiments, an outer cover is not included.

In cases when an outer cover is needed, outer cover 50 is initially placed on the ground (step 202). Outer cover 50 is a slippery, rodent- and UV-resistant cover such as woven coated polypropylene. Outer cover 50 includes a bottom portion 56, a closure flap 58 and a top portion 59 configured to be positioned over sleeve 12 when bags 13 are positioned within sleeve 12. In some embodiments, as shown in FIG. 3A, top portion 59 is initially in a rolled up configuration, which can later be unrolled as it is positioned over sleeve. Next, sleeve 12 is provided (step 204). Sleeve 12 has a front end 14, a back end 16 and a body 18 extending from front end 14 to back end 16. When held open, sleeve 12 further includes a top portion 17 and a bottom portion 19. Back end 16 is pre-sealed, and an opening 20 is formed at front end 14 for introduction of bags 13 having an agricultural commodity therein. An inner cavity 22 is defined by body 18, within which bags 13 will sit after loading of sleeve 12. Inner cavity 22 is held open via an inner cavity opener 26. In one embodiment, inner cavity opener 26 is a hanging frame 28 of any convenient geometry, such as depicted in FIGS. 3A-3C. In another embodiment, inner cavity opener 26 is a set of inflatable ribs 62, such as those depicted in FIGS. 5A and 9. In yet another embodiment inner cavity opener 26 is a blower, as shown in FIG. 5B. In the case of a blower, a frame is used as well, but it may be a single front frame to which the sleeve is attached, as will be described in greater detail.

For the embodiment wherein inner cavity opener 26 is a frame 28, frame 28 is provided (step 207) and sleeve 12 is attached (step 208) to frame 28 via an attachment mechanism 30. Frame 28 is, for example, a lightweight bolt-together tubular frame structure similar to that used in the PITS tunnel as described in U.S. Pat. No. 6,609,354 and U.S. Pat. No. 6,941,727, both of which are incorporated herein by reference in their entireties and for all purposes. Attachment mechanism 30 may be, for example, Bungie cords or springs attached to frame 28 via hooks and attached to sleeve 12 via clips. Hooks, strings, cords or other attachment means are configured to attach portions of sleeve 12 to portions of frame 28. Thus, for example, as shown in FIG. 3A, attachment mechanism 30 is configured to hang from frame 28, and sleeve 12 is hung from attachment mechanism 30 at multiple locations, resulting in an open inner cavity 22. Bottom portion 56 of outer cover 50 is positioned under sleeve 12, and top portion 59 is rolled up or folded alongside sleeve 12. As shown in FIG. 3A, top portion 59 is positioned internally with respect to frame 28. Top portion 59 is connected via ropes 32 or pulleys or other means for pulling top portion 59 over sleeve 12 when sleeve 12 is full.

Reference is now made to FIG. 3B, which is an illustration of system 10 while being loaded. A protective mat 15 is placed (step 214) on top of the bottom portion of sleeve 12 to prevent loading damage. Protective mat 15 may be a woven fabric, wire mesh, rubberized material, or other type of floor mat. Loading is then either done (step 216) manually one bag at a time or done using a forklift 92 as shown in 3B. Forklift 92 may be driven over a separate loading mat, or over a loading ramp or sheet of corrugated metal. Alternatively, protective mat 15 may extend out of sleeve 12, and forklift 92 may be driven over the extended portion of protective mat 15. Protective mat 15 can be progressively removed as loading proceeds gradually by pulling out the mat immediately before lowering pallets or bags starting at the front of sleeve 12, or protective mat 15 can be left in place when the attachment to the frame is removed. A fully loaded sleeve 12 is shown in FIG. 3C.

Next, as shown in FIG. 3D, top portion 59 of outer cover 50 (when used) is extended (step 218) over sleeve 12 via ropes 32, as shown in FIG. 3C, or other means. Frame 28 may remain in place during extension of top portion, as shown in FIG. 3C, and removed afterwards, as shown in FIG. 3D. Alternatively, frame 28 may be removed prior to extension of top portion 59. Outer cover 50 may be secured (step 220) on one side by a heavy duty zipper, or, if rodent activity is suspected, it may be replaced by eyelets and rope to ensure a taut rodent-resistant surface by stretching the outer cover. The heavy duty zipper may be supplemented by tensioning straps to ensure a taut, rodent-resistant outer surface.

System 10 may further include a sensing port for self-monitoring, similar to sensing ports disclosed in U.S. patent application Ser. No. 11/677,636, entitled "System and Method for Self-Verification of Safe Storage within Hermetically Sealed Containers," filed Feb. 22, 2007, and published as US Publication Number 2008/0202212 on Aug. 28, 2008 and incorporated herein by reference in its entirety and for all purposes. Sensing port 60 may extend through both sleeve 12 and outer cover 50, when applicable. Sensing port 60 may further include a pressure relief valve to prevent over-pressure.

In some embodiments, sleeve 12 may be rolled back on itself (inverted) or folded in accordion-type pleats, to present a shallow tunnel, such as can be done with large trash bags, and then progressively unrolled or stretched as loading proceeds.

Figure 5A:
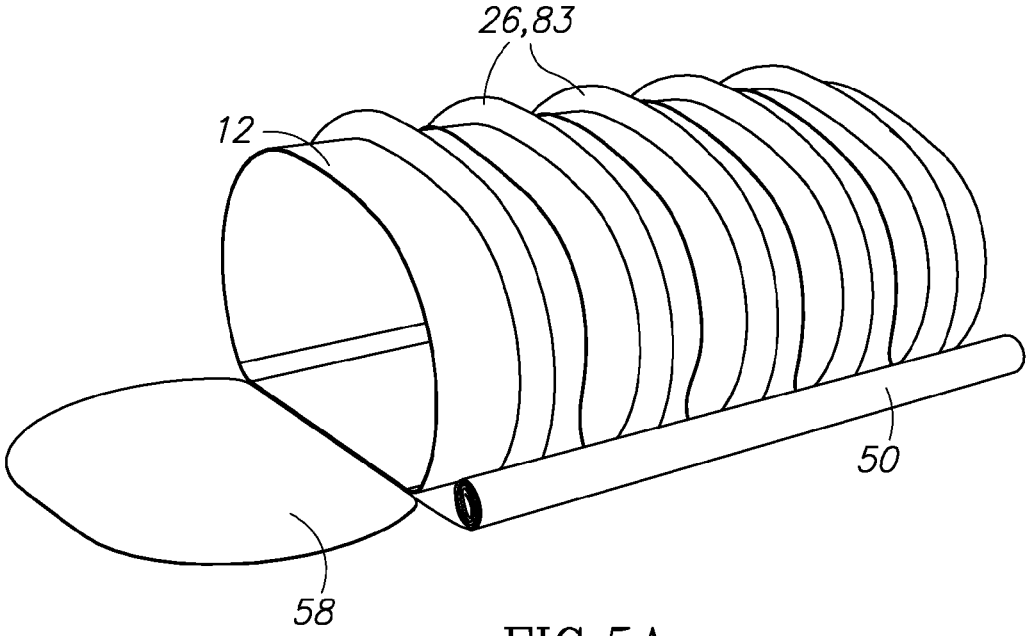
FIG. 5A is a schematic illustration of the system of FIGS. 1A and 1B, further including a series of air inflatable ribs attached to the sleeve of the system.
Figure 5B:
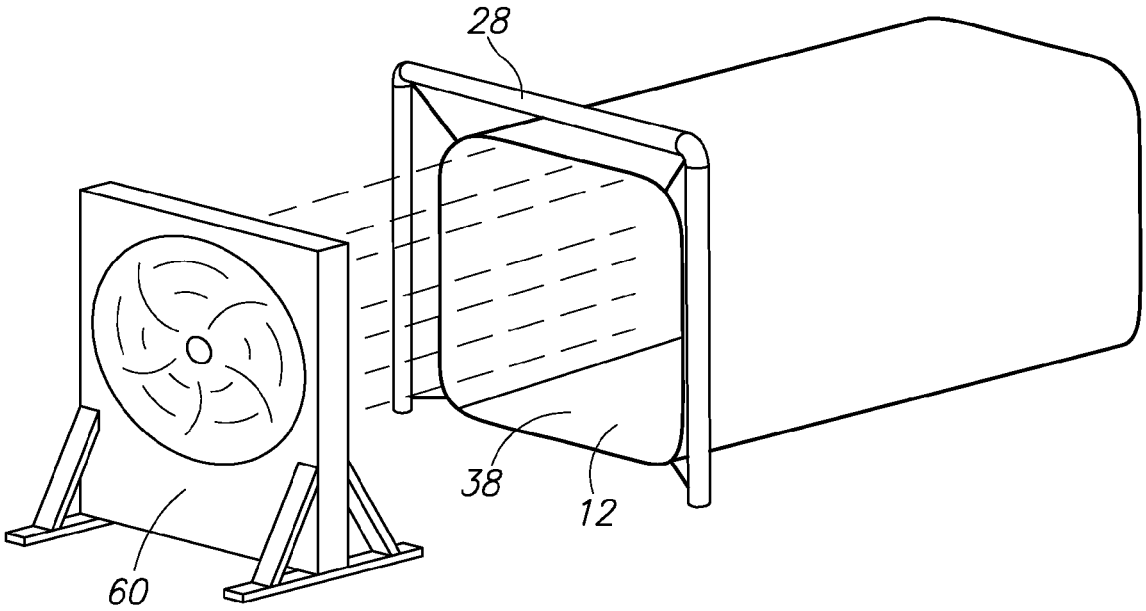
FIG. 5B is a schematic illustration of a blower/fan positioned at a distance from the sleeve.

In an alternative embodiment, as shown in FIG. 5A, inner cavity opener 26 comprises a series of air inflatable ribs 83 incorporated within or attached to sleeve 12. Sleeve 12 has a substantially ellipsoidal shape with a flat bottom, and is opened and maintained in an open state by inflating (step 210) inflatable ribs 83. Inflation or deflation of ribs 83 may be controlled via a valve 85 which, for example, may be similar to a valve used on a tire of an automobile. While sleeve 12 is open, a protective mat may be placed (step 214) inside and commodities loaded (step 216) therein.

In an alternative embodiment, as shown in FIG. 5B, a blower/fan 60 is provided and positioned (step 212) at a distance from sleeve 12. Sleeve 12 is attached to a frame 28 having a single frame section to prevent it from being blown away, and is then expanded or blown open (step 213) via airflow from blower/fan 60 so as to form opening 38. The distance between blower/fan 60 and sleeve 12 may be any suitable distance, such as, for example, up to 5 meters to allow ease of loading. While sleeve 12 is being expanded, a protective mat may be placed (step 214) inside and commodities loaded (step 216) therein.

Figure 6A:
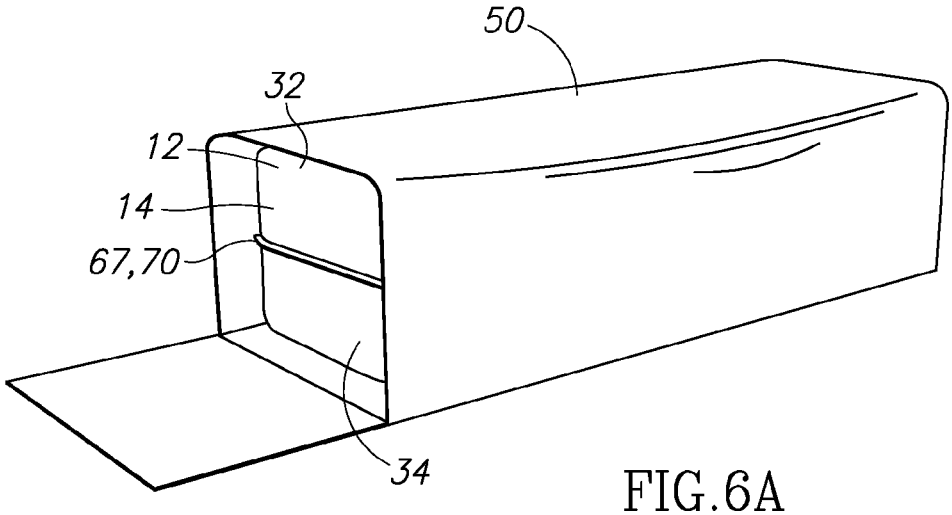
FIGS. 6A-6E are illustrations of a method of sealing the end of the sleeve with a fastener, in accordance with embodiments of the present invention.
Figure 6B:
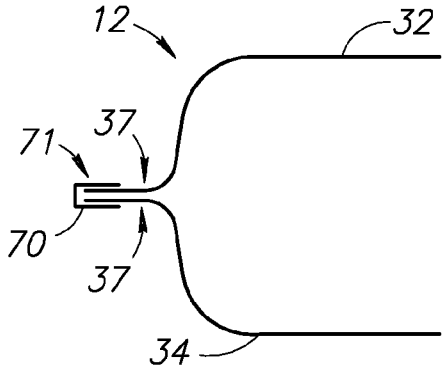

Referring now to FIGS. 6A-6E and returning to FIG. 4, after sleeve 12 is full, its end may be sealed (step 222) using a fastener 67. In one embodiment, fastener 67 is a sealing tape 70, as shown in FIGS. 6A-6D. Reference is now made to FIG. 6A, which is an illustration of sleeve 12 sealed with sealing tape 70. A top portion 32 and bottom portion 34 of sleeve 12 are brought into contact, and sealed with sealing tape 70, forming a lip 71. Reference is now made to FIG. 6B, which is a side view of sleeve 12 showing ends 37 of sleeve 12, sealed with sealing tape 70. End 37 of top portion 32 is positioned over end 37 of bottom portion 34. Sealing tape 70 is then placed around ends 37 to seal top portion 32 to bottom portion 34, thus forming a hermetic lip 71.

Figure 6C:
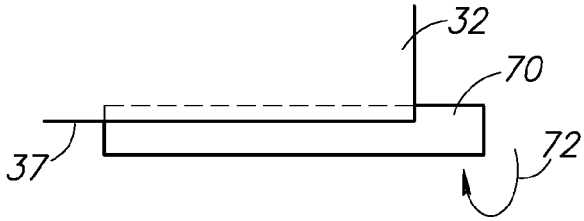
Figure 6D:
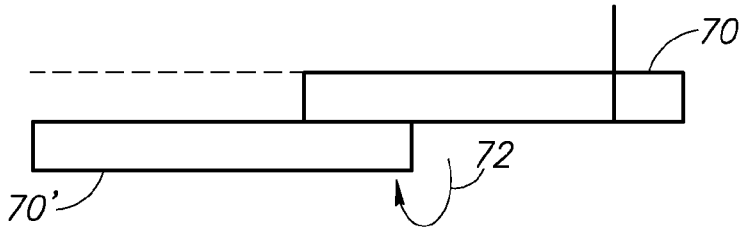
Figure 6E:
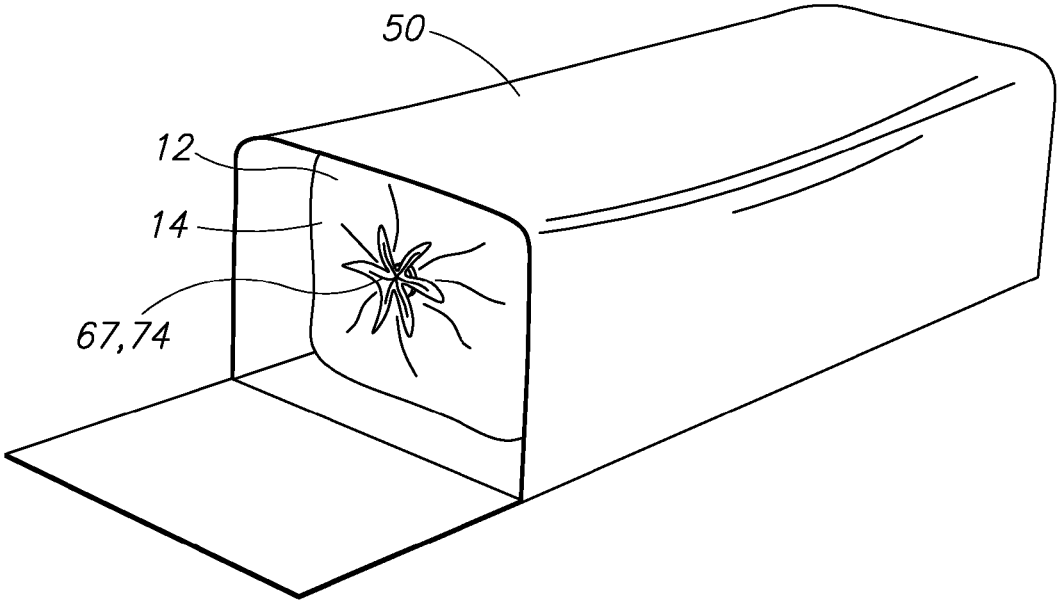

Reference is now made to FIGS. 6C and 6D, which are top-view schematic illustrations showing the process of taping ends 37 with sealing tape 70. As shown in FIG. 6C, ends 37 of top portion 32 and bottom portion 34 of liner 30 are positioned on top of one another. Since FIG. 6C is a top view, only top portion 32 is visible. Sealing tape 70 is attached to one side of ends 37—shown in FIG. 6C as attached to bottom portion 34, wherein a portion of sealing tape 70 is left unsealed and hanging over ends 37, and may be subsequently folded over in a direction shown by arrow 72 in order to seal ends 37 together. In some embodiments, an additional length of sealing tape 70 is positioned past the area of overlap of top portion 32 and bottom portion 34 to ensure airtight sealing at the egress. The amount of overlap may be one inch or more to insure air tightness. As shown in FIG. 6D, subsequent pieces of sealing tape 70 are positioned similarly, with an overlap between the first piece of sealing tape 70 and the second piece of sealing tape 70' and so on. The first piece of sealing tape 70 is shown in FIG. 6D after folding, and the second piece of sealing tape 70' is shown in FIG. 6D prior to folding, and will be folded in the direction of arrow 72, just as the first piece of sealing tape 70. This procedure is continued until sleeve 12 is completely sealed. The amount of overlap between subsequently placed pieces of sealing tape 70 may vary, and to ensure air tightness, may be in a range of one-half inch or more, for example. It is important to ensure that the tape is flat and sealed along edges 37, and it is important to avoid wrinkles in sleeve 12 under the tape, so as to avoid leaving micro-air passages. In an alternative embodiment, as shown in FIG. 6E, fastener 67 is a clamp 74 or a plastic tie (such as those used in tying bundles of electrical cables). In yet another embodiment, fastener 67 may comprise an airtight plastic zipper, similar to zippers used in "Ziploc" bags, which may be pre-welded to the liner and used as a means of sealing.

When necessary, sleeve 12 may be patched in case of puncture, by applying tape to the top of the puncture or tear. The tape must be flat and wrinkles in the liner must be avoided in order to maintain hermeticity.

Figure 7:
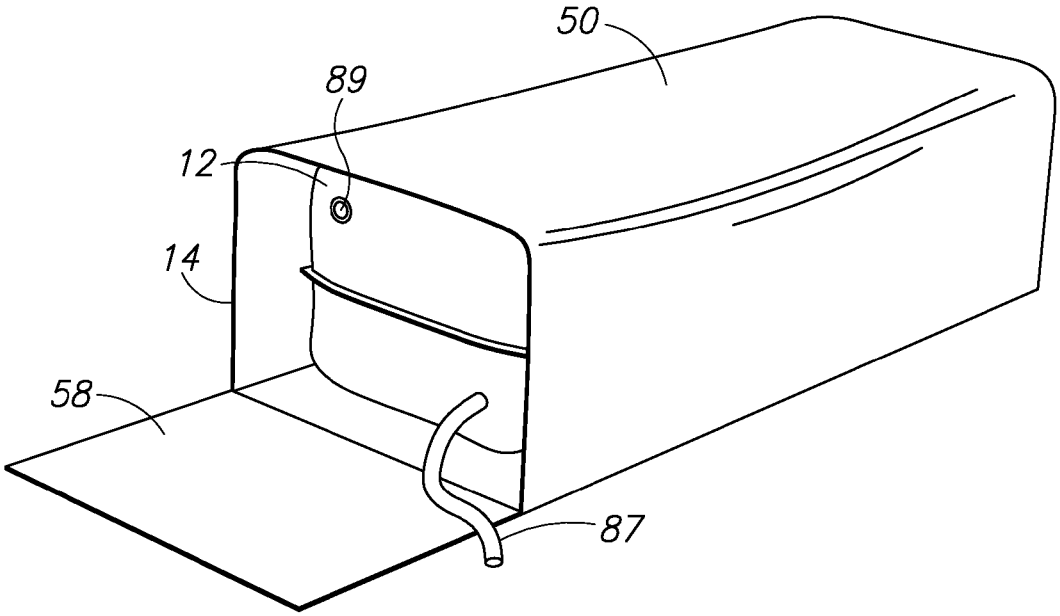
FIG. 7 is an illustration of a sleeve which is suitable for use with gas hermetic fumigation.

Reference is now made to FIG. 7, which is an illustration of a sleeve 12 in accordance with embodiments of the present invention, suitable for use with gas hermetic fumigation. At its sealed end (i.e., the front end which is sealed after loading has been completed), sleeve 12 further comprises a gas inlet valve 87 and a gas outlet valve 89. Once sleeve 12 is sealed, and the outer cover if used is closed, an inert gas such as $CO_2$ or $N_2$ is injected (step 223) into sleeve 12 via gas inlet valve 87 and air is removed via gas outlet valve 89. Gas inlet valve 87 is positioned towards a bottom portion of sleeve 12, and gas outlet valve is positioned towards a top portion of sleeve 12, since $CO_2$ is heavier than air. The inserted $CO_2$ will kill all living insects, larvae and eggs within a certain exposure time (typically 3 to 14 days, depending on the temperature, type of commodity and insect species). This step is optional, and may be performed when gas hermetic fumigation is desired.

Once sleeve 12 has been sealed, and optionally the gas hermetic fumigation has taken place, flap 58 of outer cover 50 (when used) is closed (step 224). Flap 58 is closed with a heavy duty zipper or other closure such as lacing to keep it taut in order to protect front and back from rodent and other damage, as well as to protect from over pressure, if any. If zippers are used, tensioning straps can be used to maintain tautness. Alternatively, the "clamshell design" used in the PITS tunnel can be used, and a single vertical or horizontal zipper at the middle can be used to complete closure. The frame, if used, is then rolled away.

Unloading of Sleeve:

Flap 58 may be opened, outer cover 50 unzipped or unlaced, rolled back to the two side positions and the front end back flaps of portions of "clamshell design" if used, laid flat on the ground in front and back forming a "carpet". To unload, sleeve 12 is unsealed, and the bagged agricultural commodity may be removed by forklift 92 or manually one bag at a time. As unloading proceeds, the opening can be kept open by a floor mounted fan or blower, or the liner can be gradually rolled back on itself leaving the protective floor mat stretched out. Alternatively, the loading frame 28 described earlier can be used by reusing frame 28 and attaching clips or other attachment means between frame 28 and the sleeve 12.

Version 2: For Indoor Use

Figure 8:
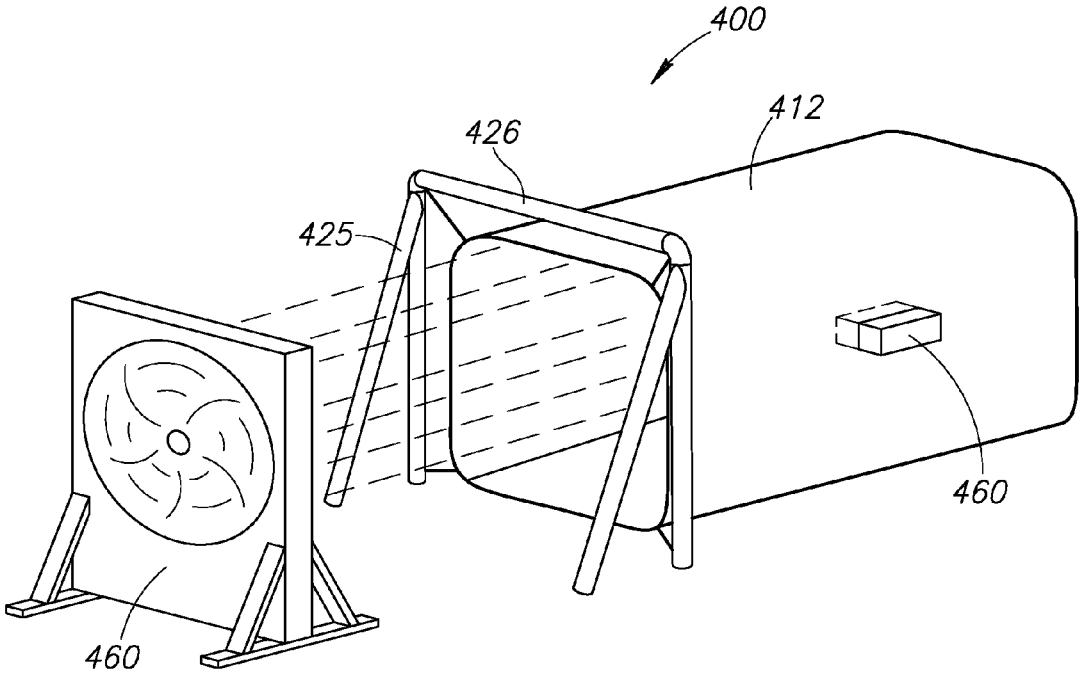
FIG. 8 is a perspective illustration of a system for free-standing storage of bagged or boxed commodities in a warehouse or other indoor environment, in accordance with embodiments of the present invention.

Reference is now made to FIGS. 8-11, which are illustrations of a system for indoor use. FIG. 8 is a perspective illustration of a system 400 for free-standing storage of bagged or boxed commodities in a warehouse or other indoor environment, in accordance with embodiments of the present invention. System 400 includes a thin, lightweight sleeve 412 for storage of bags having the agricultural commodities therein. Similar to system 10 described and shown with respect to FIG. 1A, bags may be laid on a protective mat positioned on a floor of sleeve 412 so as to protect sleeve 412 during loading and unloading of bags. System 400 may further include a sensing port 460 for self-monitoring, similar to sensing ports disclosed in U.S. patent application Ser. No. 11/677,636, entitled "System and Method for Self-Verification of Safe Storage within Hermetically Sealed Containers," filed Feb. 22, 2007, and published as US Publication Number 2008/0202212 on Aug. 28, 2008, and incorporated herein by reference in its entirety for all purposes. Sensing port 460 extends through sleeve 412.

Sleeve 412 is a thin, lightweight liner formed from a co-extruded multi-layer material having a thickness in a range of 0.08-0.2 mm with a weight of 75 to 187 gm/$m^2$ as described above with reference to sleeve 12.

Use of a thin, lightweight sleeve 412 provides a lower cost, lower weight method for storing bagged or boxed commodities. However, use of a thin, lightweight sleeve 412 such as the ones described herein creates challenges in loading and unloading of the agricultural commodity, and may not have sufficient sturdiness to withstand external influences over the long-term. Advantageously, the systems and methods of this embodiment are designed for facilitating loading and unloading of bagged agricultural commodities when using a lightweight sleeve for hermetic storage in a warehouse or other indoor facility.

Sleeve 412 is held open by a frame 426 and a blower 460. Sleeve 412 and frame 426 are positioned inside an indoor facility 427 such as a warehouse. Ropes or stands 425 may be used to prevent sleeve 412 from blowing away due to pressure from blower 460. In some embodiments, multiple sleeves 412 held open by frames 426 and blowers 460 are positioned within one indoor facility 427. Bags of an agricultural commodity are loaded as described above with reference to system 10.

Figure 9A:
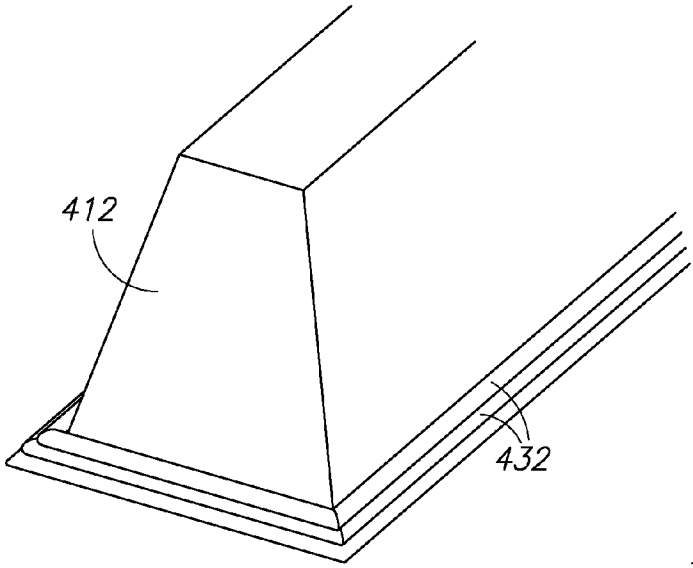
FIG. 9A is a perspective illustration of a sleeve of FIG. 8 after loading.
Figure 9B:
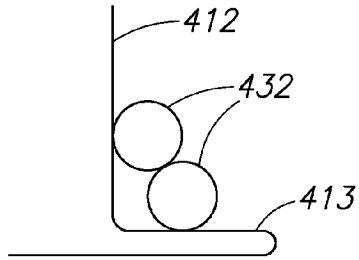
FIG. 9B is a cross-sectional illustration of a sealed portion of the sleeve of FIG. 9A.

Reference is now made to FIG. 9A, which is a perspective illustration of sleeve 412 after loading and to FIG. 9B, which is a cross-sectional illustration of a sealed portion of sleeve 412. After loading, sleeve 412 may be sealed via the use of a heavy object such as a water-filled or sand-filled sleeve 432, also known as a "snake." An extension portion 413 of sleeve 412 extends outwardly, and may be folded under itself, as shown in FIG. 9B. A hermetic seal can be obtained by placing water-filled sleeve 432 (or multiple water- or sand-filled sleeves 432, as shown in FIG. 9B) over extension portion 413, to securely hold sleeve 412 in place. Alternatively, sand bags or other heavy objects may be used. In some embodiments, side walls of sleeve 412 are slightly tapered so that water-filled or sand-filled sleeve 432 holds the side walls under tension. The side walls may also be stretched to increase the tension. This configuration prevents rodents from biting the taut, slippery surface. In additional embodiments, separate rodent guards are provided, such as low fences.

Figure 10:
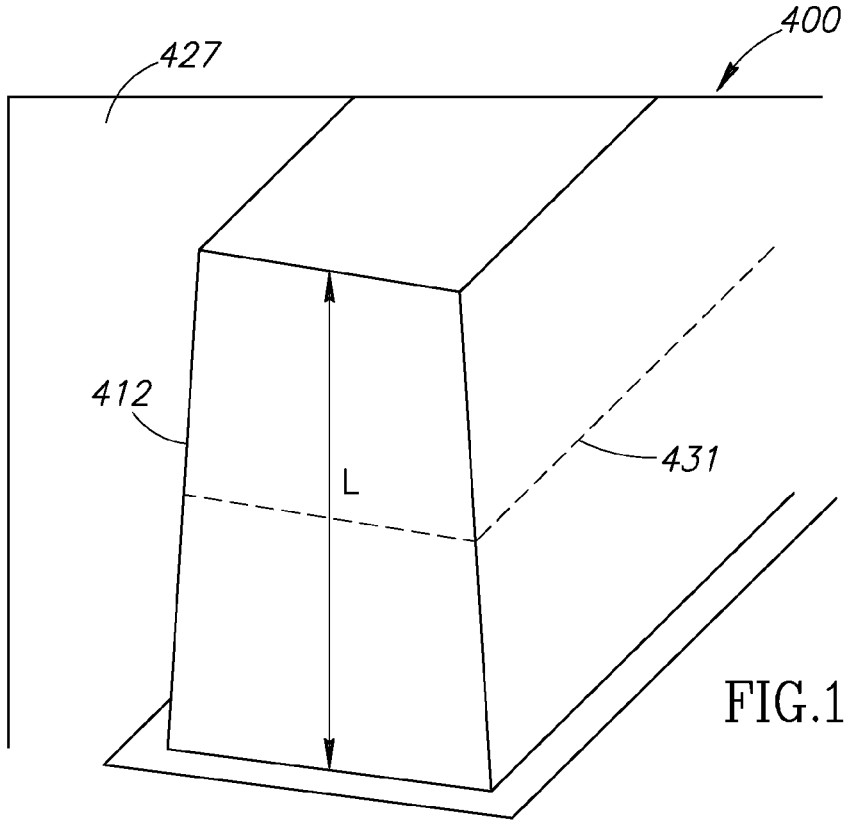
FIG. 10 is a perspective illustration of a system in accordance with another embodiment of the present invention, designed to maximize the use of vertical space of an indoor facility.

Reference is now made to FIG. 10, which is a perspective illustration of system 400 in accordance with another embodiment of the present invention. System 400 is designed to maximize the use of vertical space of indoor facility 427. Since sleeves 412 such as the ones described herein generally are commercially available in pre-set sizes, it may be necessary to modify the commercially available materials in order to maximize the use of vertical space within indoor facility 427. In order to accomplish this, two commercially available sleeves may be cut along one edge each, and the cut edges may be lined up against one another and welded together, as shown by dotted lines 431. The entire structure is then sealed as described with respect to FIGS. 9A and 9B.

Figure 11:
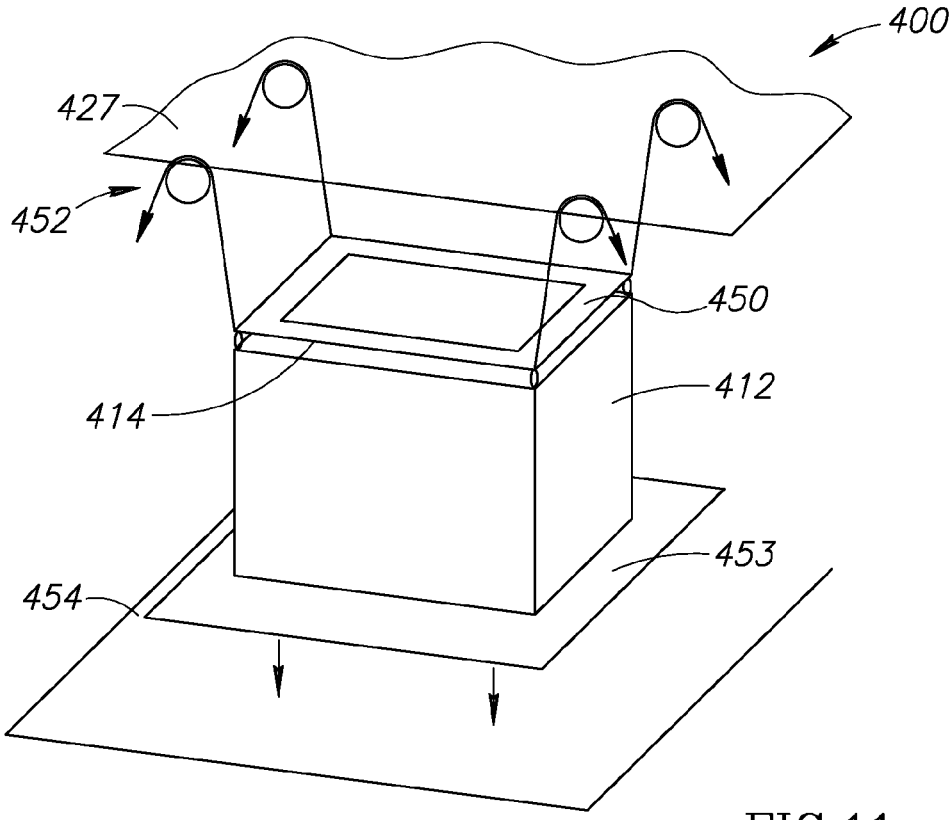
FIG. 11 is a perspective illustration of a system in accordance with yet another embodiment of the present invention, also designed to maximize the use of vertical space of an indoor facility.

Reference is now made to FIG. 11, which is a perspective illustration of system 400 in accordance with yet another embodiment of the present invention, also designed to maximize the use of vertical space of indoor facility 427. In this embodiment, a commercially available sleeve may be rotated and positioned such that an open end is facing downward. Sleeve 412 thus resembles a top hat, which can be placed over bagged commodities already in indoor facility 427. One way of accomplishing this is by attaching an upper end 414 of sleeve 412 to a platform 450 suspended from a ceiling of indoor facility 427 via pulleys 452 or the like, or any other movable suspension mechanism. A lower sheet 454 is positioned on a floor of indoor facility 427. Bags are first loaded onto lower sheet 454, and sleeve 412 is then lowered onto the loaded bags. An extended portion 453, or a flange, is provided at the bottom of the sleeve 412 to allow sealing the sleeve 412 to the bottom sheet 454, and weights as described above (such as water- or sand-filled snakes) are used to assure a seal between extended portion 453 of sleeve 412 and sheet 454. Extended portion 453 may be comprised of the same material as sleeve 412, or of any other suitable material, and may not need to be of low permeability as does sleeve 412. In some embodiments, sleeve 412 is comprised of two sleeves welded together, as described above with reference to FIG. 11. This configuration allows for maximizing height of the sleeve, as it can be extended vertically as far as desired.

Bulk Agricultural Commodities

Figure 12:
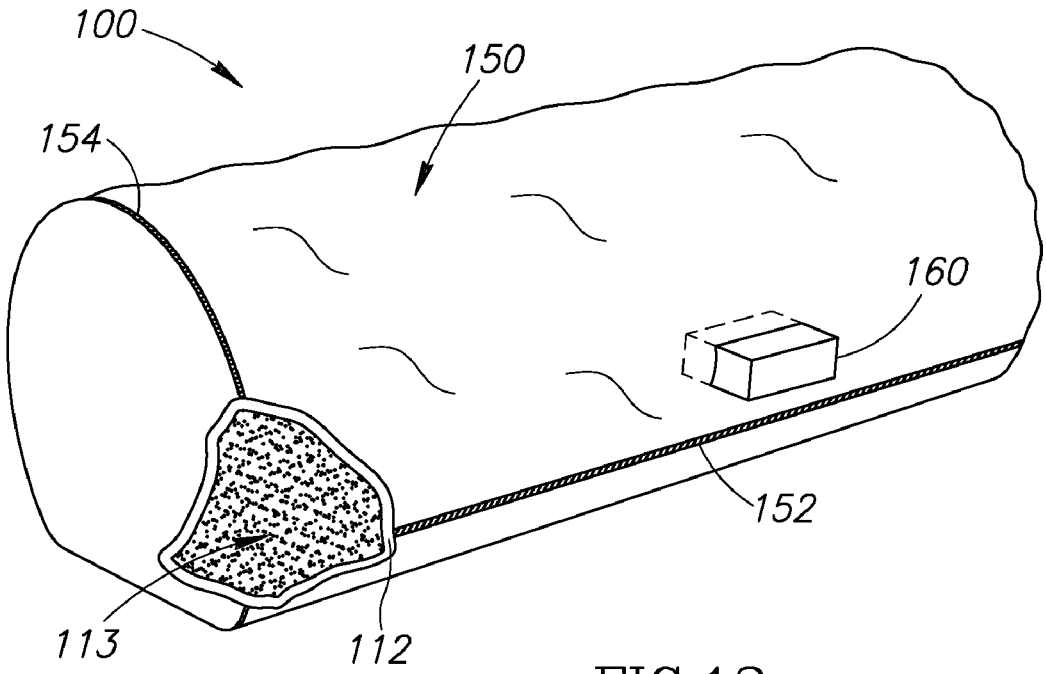
FIG. 12 is a schematic illustration of a system for free-standing storage of bulk agricultural commodities, in accordance with embodiments of the present invention.

Reference is now made to FIG. 12, which is a schematic illustration of a system 100 for free-standing storage of bulk agricultural commodities, in accordance with embodiments of the present invention. A purpose of such a system is to allow bulk storage of granular commodities without requiring the use of bags, boxes or the like to contain the commodity in a lightweight low-cost portable design. As such, system 100 can be described as "stuffing a sausage" wherein a lightweight hermetic liner is provided along with a strong outer cover surrounding the liner during the "stuffing" so as to prevent the thin liner from bursting. As such, system 100 is substantially circular or ellipsoidal in cross-section rather than rectangular as in system 10 for storage of bagged commodities. System 100 includes a thin, lightweight sleeve 112 for storage of grains 113 of agricultural commodities. An outer cover 150 is positioned over sleeve 112. Outer cover 150 may include a side zipper 152 and a front zipper 154 for closure of outer cover 150. It should be readily apparent that any type of closure may be used, such as a clam shell closure, for example. System 100 may further include a sensing port for self-monitoring, similar to sensing ports disclosed in U.S. patent application Ser. No. 11/677,636, entitled "System and Method for Self-Verification of Safe Storage within Hermetically Sealed Containers," filed Feb. 22, 2007, and published as US Publication Number 2008/0202212 on Aug. 28, 2008 and incorporated herein by reference in its entirety and for all purposes. Sensing port 160 may extend through both sleeve 112 and outer cover 150, when applicable. Sensing port 160 may further include a pressure relief valve to prevent overpressure.

Sleeve 112 is a thin, lightweight liner formed from a co-extruded ultra low permeability multi-layer material having a thickness in a range of 0.08-0.2 mm with a weight of 75 to 187 $gm/m^2$ as described above with reference to sleeve 12.

Use of a thin, lightweight sleeve 12 provides a lower cost, lower weight method for storing bulk commodities. However, use of a thin, lightweight sleeve 112 such as the ones described herein creates challenges in loading and unloading of the agricultural commodity, and does not provide sufficient rigidity or sturdiness to withstand pressure of introduction of grains therein. Thus, the systems and methods of the present invention are designed for facilitating loading and unloading of bulk agricultural commodities when using a lightweight sleeve for hermetic storage.

Figure 13:
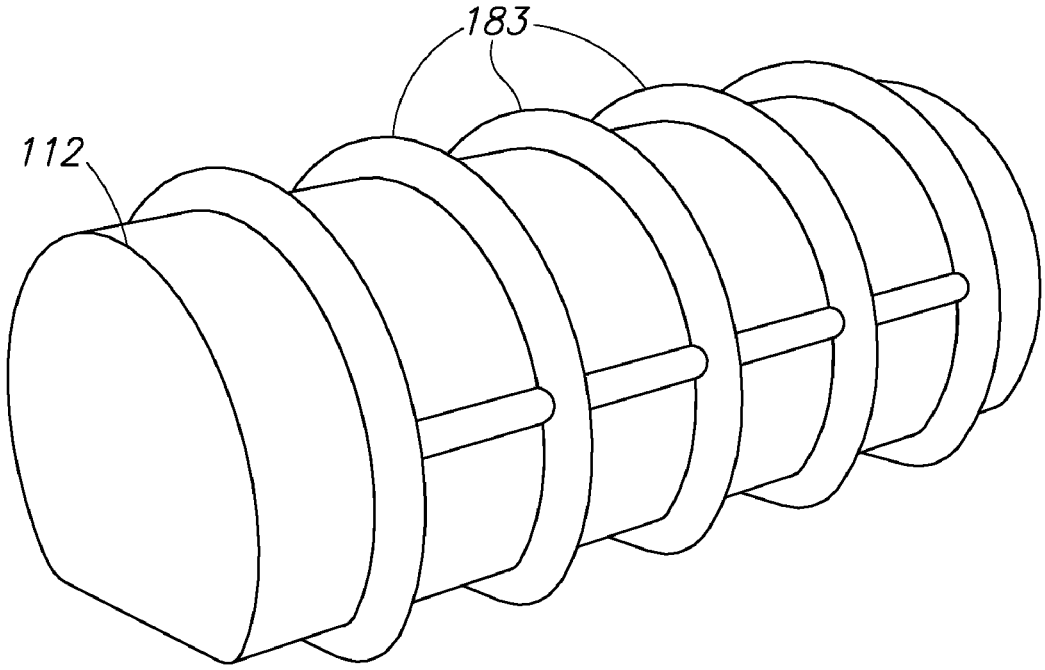
FIG. 13 is an illustration of the system of FIG. 12, shown with a series of air inflatable ribs attached to the sleeve.

Sleeve 112 is pre-sealed at one end and open at the other end. As shown in FIG. 13, sleeve 112 may include a series of interconnected air inflatable ribs 183 incorporated within or attached to sleeve 112. Sleeve 112 is opened and maintained in an open state by inflating interconnected inflatable ribs 183. Inflation or deflation of ribs 183 may be controlled via a valve which, for example, may be similar to a valve used on a tire of an automobile.

Figure 14A:
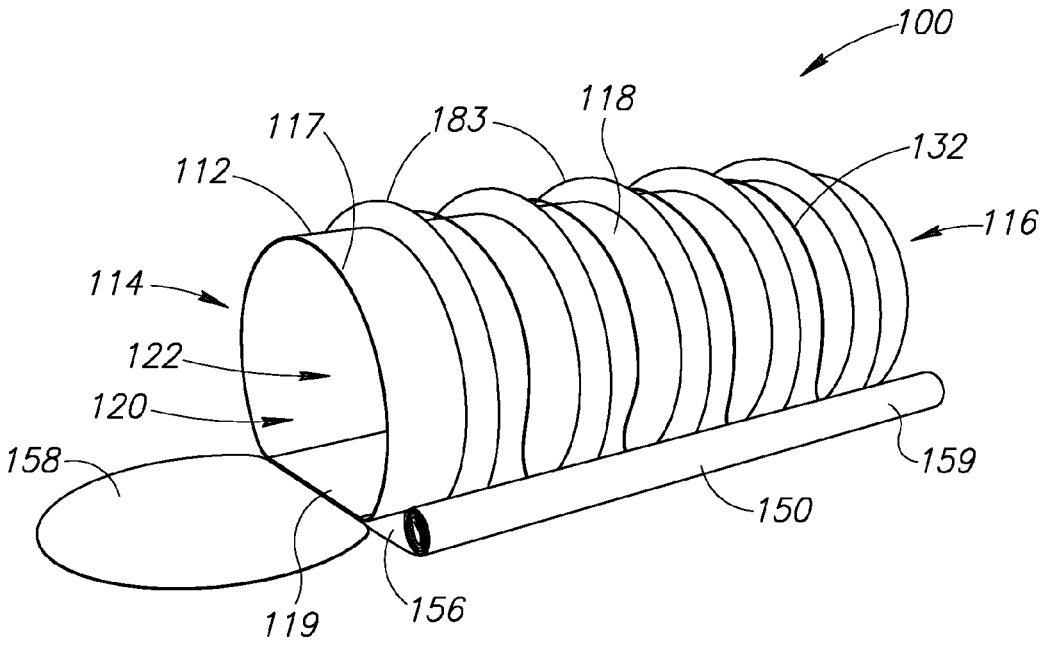
FIGS. 14A-14C are schematic illustrations of steps of a method of holding the sleeve of FIG. 12 open and loading grains therein, in accordance with embodiments of the present invention.
Figure 14B:
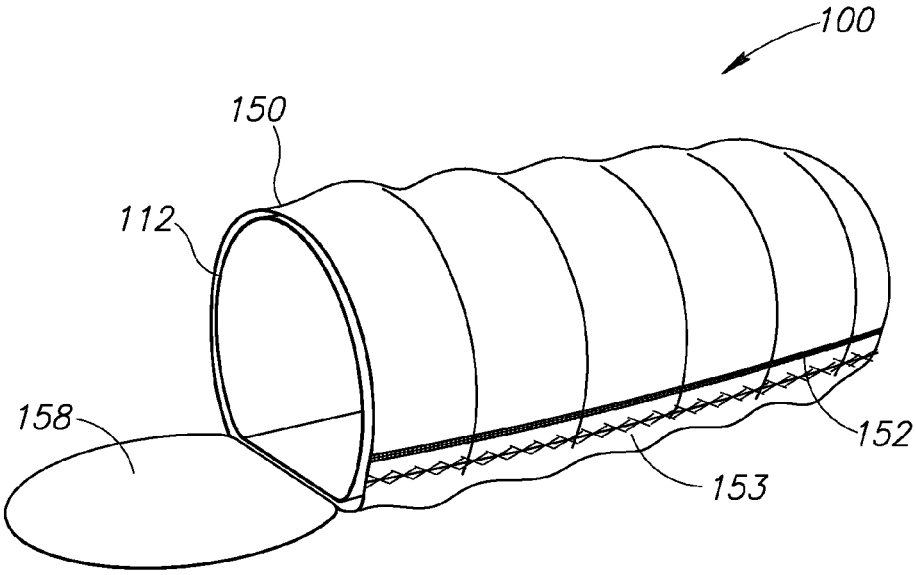
Figure 14C:
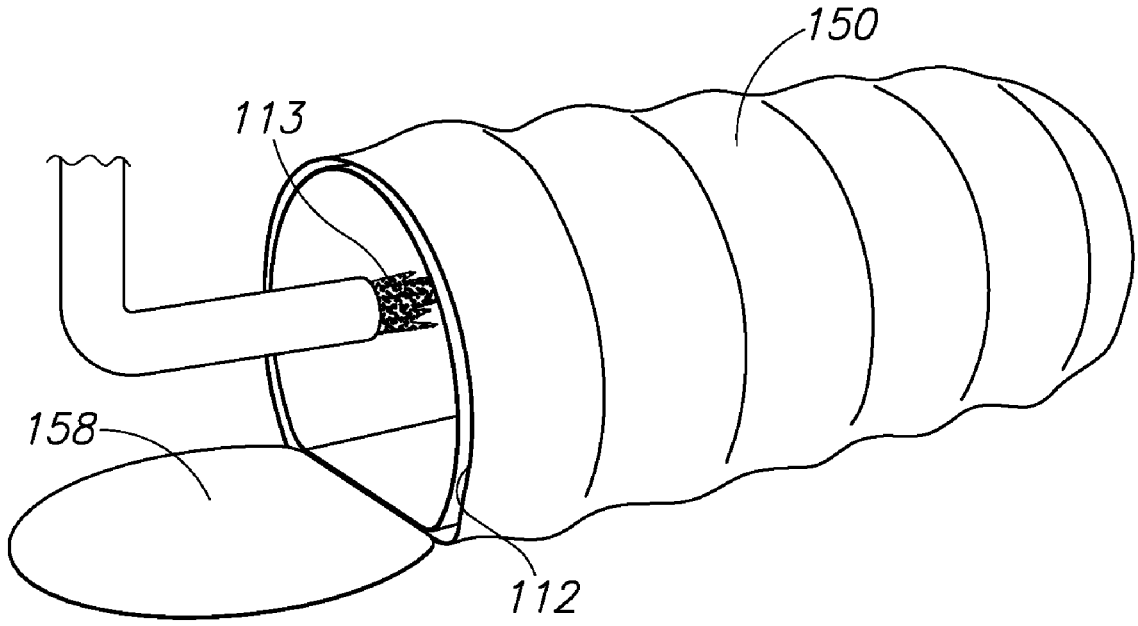
Figure 15:
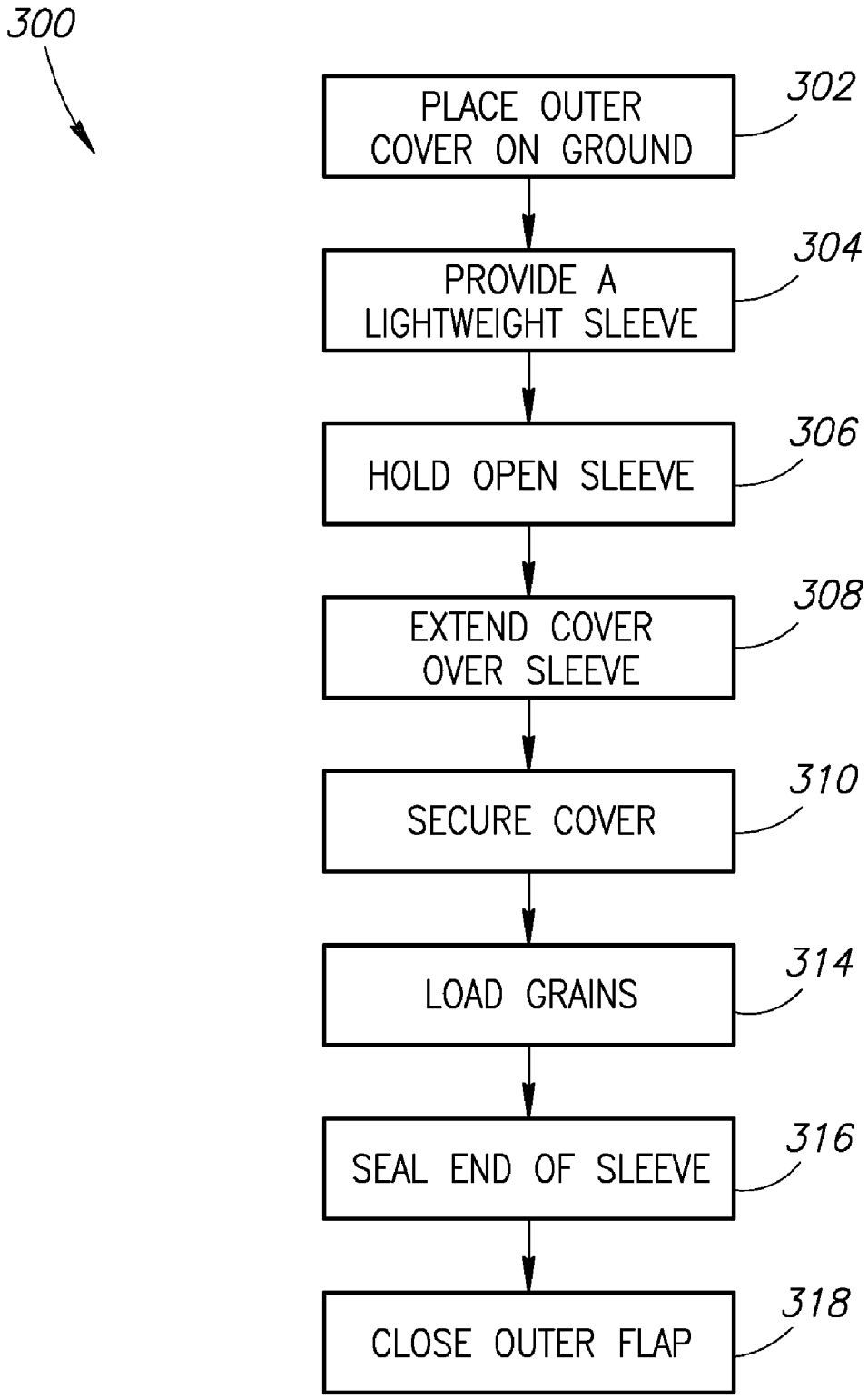
FIG. 15 is a flow-chart diagram of the method of FIGS. 14A-14C.

Reference is now made to FIGS. 14A-14C and to FIG. 15, which are schematic illustrations and a flow-chart diagram, respectively, of steps of a method 300 of holding sleeve 112 open and loading grains 113 therein, in accordance with embodiments of the present invention.

An outer cover 150 is initially placed on the ground (step 302). Outer cover 150 is a slippery, rodent- and UV-resistant cover such as woven coated polypropylene. Outer cover 150 includes a rollable cover portion 156 and a closure flap 158. Rollable cover portion 156 of outer cover 150 is positioned over sleeve 112 prior to introduction of grains 113 into sleeve 112. Outer cover 150 further includes closable openings for introduction of a loading/unloading mechanism and for a pressure relief valve. Next, a lightweight sleeve 112 is provided (step 304). Sleeve 112 has a front end 114, a back end 116 and a body 118 extending from front end 114 to back end 116. When held open, sleeve 112 constitutes an approximate cylinder 119. Back end 116 is pre-sealed, and an opening 120 is formed at front end 114 for introduction of grains of an agricultural commodity. An inner cavity 122 is defined by body 118, within which grains will sit after loading of sleeve 112. Inner cavity 122 is held open (step 306) via inflatable ribs 183. Sleeve 112 may further include one opening or two separate openings for loading/unloading and may include a separate opening for a pressure relief valve. Valve openings may be closed by threaded caps.

Reference is now made to FIG. 14B, which is an illustration of system 100 showing cover 150 placed over liner 112. Cover 150 may be extended (step 308) over sleeve 112 by unrolling top portion 150 via ropes 132 (shown in FIG. 14A) or other means. Outer cover 150 may be secured (step 310) on one side by a heavy duty zipper 152, or, if rodent activity is suspected, it may be replaced by eyelets and rope 153 to ensure a taut rodent-resistant surface by stretching the outer cover. The heavy duty zipper may be supplemented by tensioning straps to ensure a taut, rodent-resistant outer surface.

In another embodiment, inner cavity 122 is held open via a blower and tied to a single section of a frame, as described and shown with respect to bagged commodities in FIG. 5B, for example. A blower/fan 60 is provided and positioned at a distance from sleeve 112. Sleeve 112 is expanded or blown open via airflow from blower/fan 60 so as to form an opening 38. The distance between blower/fan 60 and sleeve 112 may be any suitable distance, such as, for example, up to 5 meters to allow ease of loading. While sleeve 112 is being expanded, cover 150 is placed around sleeve 112 and grains 113 are loaded (step 314) therein. Loading of grains 113 is done using a grain blower or other loading means, as shown in FIG. 14C.

After sleeve 112 is full, its end may be sealed (step 316) using a fastener 67 in accordance with the description with reference to sleeve 12 and FIGS. 6A-6D above. Fastener 67 may be sealing tape, a clamp or a plastic tie, an airtight plastic zipper, or any other suitable sealing means.

When necessary, sleeve 112 may be patched in case of puncture, by applying tape to the top of the puncture or tear. The tape must be flat and wrinkles in the liner must be avoided in order to maintain hermeticity.

Sleeve 112 may be modified for gas hermetic fumigation, as described for sleeve 12 above with reference to FIG. 7. Once sleeve 112 has been sealed, and optionally the gas hermetic fumigation has taken place, flap 158 of outer cover 150 (when used) is closed (step 318). Flap 158 is closed with a heavy duty zipper or other closure such as lacing to keep it taut in order to protect front and back from rodent and other damage. If zippers are used, tensioning straps can be used to maintain tautness. Alternatively, the "clamshell design" used in the PITS tunnel can be used, and a single vertical or horizontal zipper at the middle can be used to complete closure.

Unloading of Sleeve:

To unload grains 113, flap 158 is opened. Grains 113 may be removed as follows: the sealed end of sleeve 112 is opened and attached to a vacuum hose. An opening is provided at a different location of sleeve 112 for a blower to prevent the vacuum from collapsing the sleeve or from causing the commodity to stick. Grains 113 are then removed via the vacuum hose. In some circumstances, remaining grains 113 may be removed manually by opening the other end of sleeve 112, for example. After emptying system 100, outer cover 150 may be unzipped or unlaced, rolled back to the two side positions and the front end back flaps of portions of "clamshell design" if used, laid flat on the ground in front and back forming a carpet. Sleeve 112 may then be rolled back on itself little by little and the residual grains 113 removed by vacuum, broom, or other means. Sleeve 112 may then be cleaned and stored for future use.

While certain features of the present invention have been illustrated and described herein, many modifications, substitutions, changes, and equivalents may occur to those of ordinary skill in the art. It is, therefore, to be understood that the appended claims are intended to cover all such modifications and changes as fall within the true spirit of the present invention.

What is claimed is:

1. A method of hermetically storing a multi-ton load of a commodity, the method comprising:

providing a sleeve having a weight of between 75 and 187 $gm/m^2$, a permeability to oxygen of less than or equal to 55 $cc/m^2/day$ and a permeability to water vapor of less than or equal to 8 $g/m^2/day$, said sleeve having a first end, a second end, and a body extending from said first end to said second end, said first end, said second end and said body defining an inner cavity to receive a commodity, said first end comprising an opening for accessing said inner cavity;

hanging said sleeve from a frame so as to keep said opening open for loading;

loading at least one of a bag or a box of a commodity through said opening into said inner cavity; and hermetically sealing said first end of said sleeve.

2. The method of claim 1, further comprising placing a protective floor mat in said inner cavity, wherein said loading comprises loading at least one bag or box of a commodity with a forklift, or manually onto said protective floor mat.

3. The method of claim 1, further comprising placing an outer cover over said sleeve after said loading.

4. The method of claim 3, wherein initially a portion of said outer cover is positioned under said sleeve, and wherein said placing comprising placing a remaining portion of said outer cover over said sleeve and said at least one loaded bag or box, said placing done by unrolling said remaining portion of said outer cover.

5. The method of claim 1, wherein said hermetically sealing comprises sealing with tape, zip lock type closure, a clamp, or a tie.

6. The method of claim 1, further comprising placing a blower next to said opening to aid in keeping said opening open during loading.

7. The method of claim 1, further comprising providing a coating or impregnation of a compound of botanical origin to said sleeve.

8. A method of hermetically storing a multi ton bulk commodity, the method comprising:

providing a sleeve having a weight of between 75 and 187 $gm/m^2$, a permeability to oxygen of less than or equal to 55 $cc/m^2/day$ and a permeability to water vapor of less than or equal to 8 $g/m^2/day$, said sleeve having a first end, a second end, and a body extending from said first end to said second end, said first end, said second end and said body defining an inner cavity for receiving of a commodity, said first end comprising an opening for accessing said inner cavity;

keeping said opening open for loading of the commodity;

placing an outer cover over said sleeve;

propelling the commodity into said inner cavity while said opening is kept open and while said outer cover remains over said sleeve; and hermetically sealing said opening.

9. The method of claim 8, wherein initially a portion of said outer cover is positioned under said sleeve, and wherein said placing comprises placing a remaining portion of said outer cover over said sleeve by unrolling said remaining portion.

10. The method of claim 8, wherein said hermetically sealing comprises sealing with tape, zip lock type closure, a clamp or a tie.

11. The method of claim 8, wherein said keeping said opening open comprises placing a blower next to said opening and blowing air into said inner cavity.

12. The method of claim 8, wherein said keeping said opening open comprises inflating inflatable tubes attached to said sleeve.

13. The method of claim 8, further comprising providing resistance to insect penetration by providing a coating or impregnation of a compound of botanical origin to said sleeve.

* * * * *